United States Patent [19]

Austin, Jr.

[11] 4,086,833

[45] May 2, 1978

[54] TICKET ISSUING MACHINE

[75] Inventor: Harvey B. Austin, Jr., Berwyn, Pa.

[73] Assignee: Globe Ticket Company, Horsham, Pa.

[21] Appl. No.: 785,023

[22] Filed: Apr. 6, 1977

[51] Int. Cl.[2] ..... B26D 5/24

[52] U.S. Cl. ..... 83/205; 83/251; 83/265; 226/129; 226/134; 226/156

[58] Field of Search ..... 83/251, 250, 205, 265, 83/223; 226/134, 156, 129

[56] References Cited

U.S. PATENT DOCUMENTS

| | | | |
|---|---|---|---|
| 1,128,721 | 2/1915 | Ray | 83/250 X |
| 1,687,594 | 10/1928 | Schneble | 225/79 |
| 1,726,883 | 9/1929 | Brooks | 83/250 X |
| 2,041,831 | 5/1936 | Helsel | 83/251 X |
| 2,325,054 | 7/1943 | Helsel | 83/251 X |
| 2,616,500 | 11/1952 | Helsel | 226/134 X |

*Primary Examiner*—J. M. Meister

*Attorney, Agent, or Firm*—Smith, Harding, Earley & Follmer

[57] ABSTRACT

A ticket issuing machine is constructed with a ticket wheel rotatably mounted adjacent a ticket supply for feeding tickets by means of pins which engage in holes in the ticket web and a wheel advancing mechanism including a manually operable means engageable with the ticket wheel for rotating the same through a first portion of the ticket issuing stroke, and a spring-operated detent mechanism causing the ticket wheel to advance through the remainder of the ticket issuing stroke. The ticket issuing machine is also provided with a full stroke mechanism for insuring a complete ticket issuing stroke and an anti-spin mechanism for arresting the ticket wheel at the end of the ticket issuing stroke.

18 Claims, 13 Drawing Figures

TICKET ISSUING MACHINE

BACKGROUND AND SUMMARY OF THE INVENTION

This invention relates to ticket issuing machines of the type used in a supermarket, a bakery or other stores where customers pick a ticket from a machine to determine the sequence of service.

It is important for machines of this type to be sturdy in construction and reliable in operation. Also, these machines should be made simple and of inexpensive mechanisms so that the cost of manufacture is low.

It is the general object of this invention to provide a ticket issuing machine of the indicated type which has a sturdy, reliable and simple design whereby the machine may be manufactured at a low cost and is reliable in operation.

Briefly stated, the general object of the invention is achieved by the provision of a ticket issuing machine which comprises a ticket wheel rotatably mounted adjacent a ticket supply in the form of a web of tickets for feeding tickets by means of pins which engage within holes in the ticket web, and a wheel advancing mechanism which includes a manually operable means engageable with the ticket wheel for rotating the same through the first part of a ticket issuing stroke and a spring-operated detent mechanism for causing the ticket wheel to advance through the remainder of the ticket issuing stroke. The ticket issuing means is also provided with a full stroke mechanism for insuring a complete ticket issuing stroke and an anti-spin mechanism for arresting the ticket wheel at the end of a ticket issuing stroke.

DETAILED DESCRIPTION OF THE PREFERRED EMBODIMENT

Figure 1:
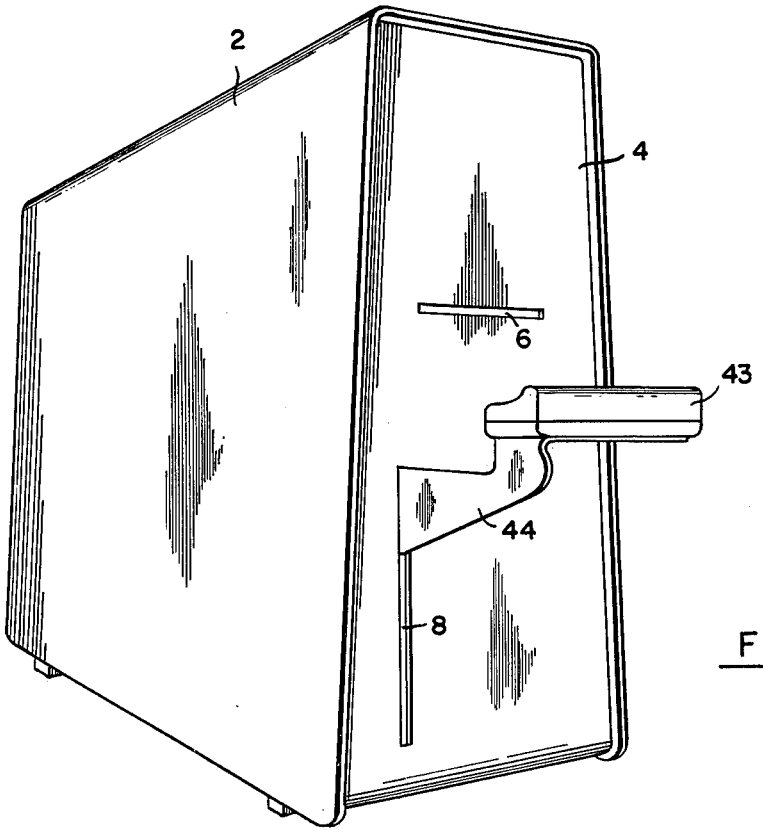
FIG. 1 is a perspective view of the ticket issuing machine in accordance with the invention.

The ticket issuing machine in accordance with the invention comprises a casing which includes cover 2 and a base 4, each of which is generally U-shaped. Cover 2 and base 4 fit together to provide an enclosure for the ticket issuing mechanism. An upright leg of base 4 is provided with a horizontally extending slot 6 through which the tickets are issued and a vertically extending slot 8 through which the operating handle of the ticket issuing machine extends. A component mounting plate 10 is secured in a vertically extending position to the base 4 by means of suitable mounting screws and brackets. As will appear hereafter, all of the components of the ticket issuing mechanism are supported on the plate 10.

A ticket wheel 12 is rotatably mounted on the plate 10 adjacent the ticket issuing slot 6. Ticket wheel 12 is molded in one piece out of a synthetic resin and is provided with a inner rim 14, a radial web 16 and an outer rim 18. Inner rim 14 has a hexagonal inner wall 15. Six circumferentially equally spaced ticket indexing pins 20 are located on the periphery of the outer rim 18 and project outwardly therefrom.

Figure 4:
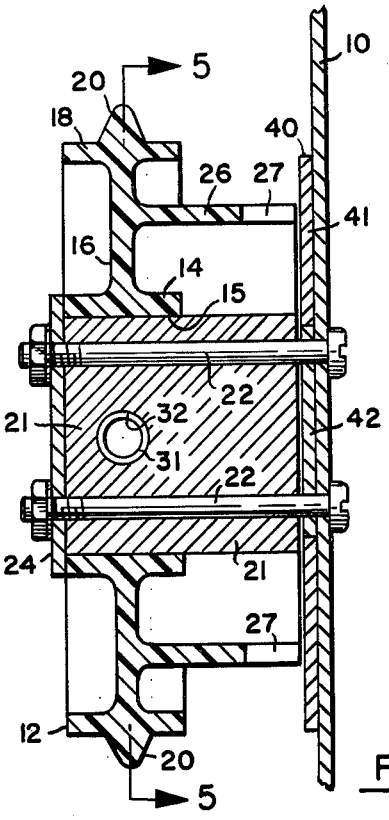
FIG. 4 is a sectional view of the ticket wheel assembly.

Ticket wheel 12 is rotatably mounted on a cylindrical hub 21 fixedly mounted on the plate 10 by means of a pair of mounting bolts 22 which extend axially through the hub 21 as is shown in FIG. 4. Carried on the end of the bolts 22 is a hub cap 24 which retains the ticket wheel 12 on the hub 21.

The ticket wheel 12 is provided with a central rim 26 extending laterally from the web 16 at a location between the inner rim and the outer rim 18. Central rim 26 is provided with six laterally extending slots 27 aligned radially with the pins 20 and six circumferentially extending slots 28. The slots 28 extend circumferentially from the slots 27 about half the distance between the slots 27 for a purpose to be described hereafter.

Figure 5:
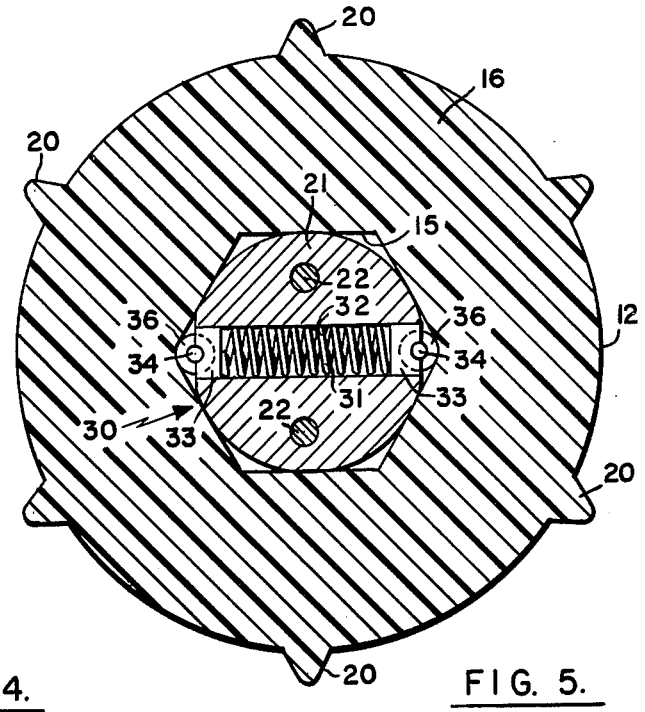
FIG. 5 is a sectional view taken on line 5—5 of FIG. 4.

A spring-operated detent mechanism 30 is mounted in the hub 21 and cooperates with the hexagonal inner wall 15 of inner rim 14 to actuate the ticket wheel 12 through the terminal part of a ticket issuing stroke. The detent mechanism comprises a compression spring 31 mounted in a bore 32 extending through the center of the cylindrical hub 21 transversely to the longitudinal axis thereof. A cradle 33 is located at each end of the spring 31 and has a generally cylindrical shape to slide along the axis of the bore 32 with a minimum of friction. Each cradle 33 supports a transversely extending pin 34 as shown in FIG. 5. Mounted on each of the pins 34 is a roller bearing 36 of the ball bearing type having a roller member which projects outwardly from the hub 21 into contact with the inner wall 15 of the inner rim 14 of the ticket wheel 12. The detent mechanism 30 is lubricated so that there is a minimum of friction between the wall of bore 32 and the parts moving axially therein.

Since the spring 31 urges the roller bearings 36 outwardly with considerable force, the detent mechanism 30 tends to position the roller bearings 36 within aligned apexes of the hexagonal inner wall 15 as is shown in FIG. 5. As the ticket wheel 12 is rotated from this position, the inner wall 15 of the hexagonal inner rim 14 will initially cause the roller bearings 36 to move into the bore 32, the spring 31 being compressed to accommodate this movement. After the ticket wheel 12 is moved past the halfway point between the apexes of the hexagonal inner wall 15, the spring 31 will expand causing the roller bearings 36 to move outwardly and, by a camming action, drive the ticket wheel 12 to the next index position where the roller bearings 36 are within the next apex of the hexagonal inner wall 15. In this manner, the detent mechanism 30 will operate to drive the ticket wheel 12 during the terminal portion of a ticket issuing stroke after the ticket wheel 12 has been advanced through the first part of the stroke by manual operation as will be described hereafter.

There is provided manually operable means engageable with the ticket wheel 12 for causing rotation thereof through a first part of the ticket issuing stroke. Such means comprises a member 40 having an annular portion 41 rotatably mounted on a circular disk 42 which is secured onto the plate 10 by means of the mounting bolts 22 at a location between the hub 21 and the plate 10 as is shown in FIG. 4.

Figure 3:
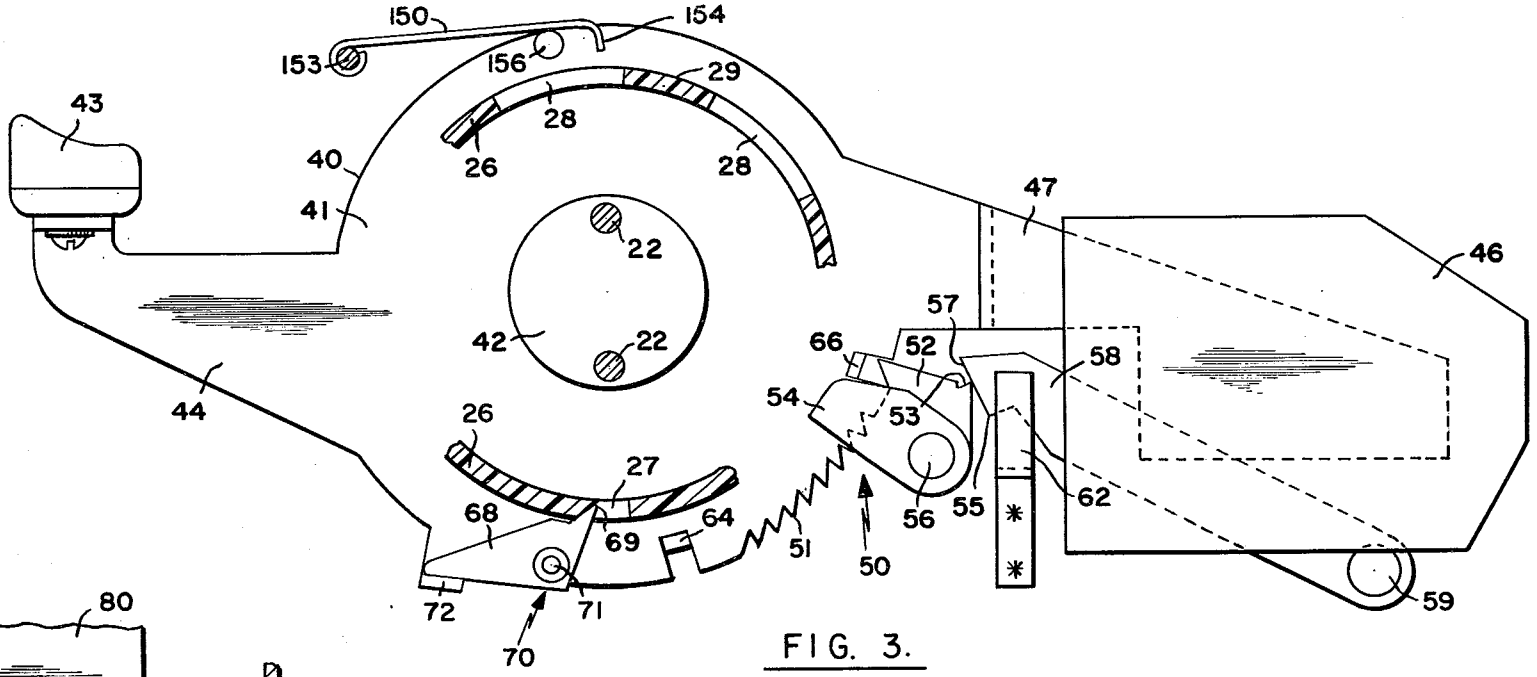
FIG. 3 is a fragmentary view showing the ticket wheel advancing mechanism.
Figure 11:
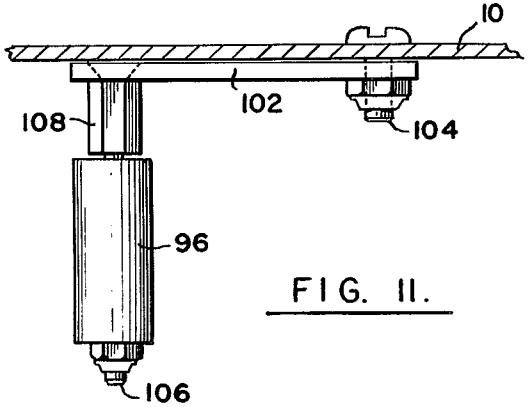
FIG. 11 is a fragmentary view showing the dancer assembly.

The member 40 is manually operable to be rotated about the disk 42 by means of a handle 43 supported at the end of a handle lever 44 which extends from the annular portion 41 of member 40 through the slot 8. The lever 44 is normally held in contact with the upper end of the vertical slot 8 by means of a counterweight 46 secured on the end of a counterweight lever 47 which extends outwardly from the annular portion 41 of member 40 as shown in FIG. 3. By this arrangement, the counterweight 46 biases the member 40 in a counterclockwise direction as viewed in FIG. 3 to position the handle 43 in the horizontal "rest" or "start" position as shown in FIG. 1. By moving the handle 43 through a downward stroke from this position, the ticket wheel 12 will be actuated through a first part of its ticket issuing stroke as will be apparent hereafter. Upon release of the handle 43, the counterweight 46 causes clockwise movement of the member 40 and a returning upward movement of the handle 43 to the rest position.

The manually operable wheel advancing mechanism comprises a pair of pawl means 50 indicated generally at 50 and 70. The pawl means 50 cooperates with the member 40 to insure that once the ticket issuing stroke of the ticket wheel 12 is started, it must complete a full stroke. Pawl means 70 cooperates with the ticket wheel 12 to advance the same through the first part of its ticket issuing stroke.

Pawl means 50 comprises a pawl assembly including a pawl 52 and a guide arm 54 which are welded together in the relationship shown in FIG. 3 and are pivotally mounted on a pivot pin 56 secured on the plate 10. The construction and arrangement of the pawl assembly is such that the pawl 52 is urged by gravity in a counterclockwise direction about its pivot 56 so that the tip of the pawl 52 contacts the periphery of the annular portion 41 of member 40. The annular portion 41 is provided with teeth 51 adapted to be engaged by the tip of the pawl 52 after a predetermined amount of counterclockwise rotation of the member 40 from the rest position. As the annular portion 41 of the member 40 is rotated during an ordinary advancing stroke, the pawl 52 comes into engagement with the teeth 51 by reason of the action of the arm 54 which, by gravity, urges the tip of the pawl 52 into contact with the annular portion 41. The parts are constructed and arranged so that once the pawl 52 engages the teeth 51 during an advancing stroke, the member 40 cannot move in a reverse direction, i.e. in a clockwise direction as viewed in FIG. 3.

Means are provided for holding the pawl 52 out of engagement with the teeth 51 to permit a return movement of the member 40 after a full advancing stroke. To this end, a latch level 58 is pivoted at one end on a pivot pin 59 on the plate 10 and by reason of its weight tends to pivot in a counterclockwise direction as viewed in FIG. 3. The latch arm 58 is maintained in contacting alignment with the pawl 52 by means of its mounting and a keeper 62. The latch arm 58 is provided with a surface 57 which is inclined at an angle such that it contacts a point adjacent a notch 53 on the pawl 52 so as to urge the pawl 52 toward the periphery of the annular portion 41 of the member 40 as shown in FIG. 3.

At the completion of an advancing stroke, a post 64 formed on the annular portion 41 of member 40 comes into contact with the guide arm 54 to cause the arm 54 and the pawl 52 to move in a clockwise direction about the pin 56 until the notch 53 on the pawl 52 is engaged by a pointed portion 55 on the end of the lever 58. When this occurs, the latch 58 is operative to hold the pawl 52 in a latched position out of engagement with the teeth 51 to thereby permit a clockwise movement of the annular portion 41 of the member 40, which movement occurs during the return stroke of the member 40 after the completion of a full ticket issuing stroke. At the end of this return movement, a post 66 formed on member 40 comes into contact with the guide arm 54 to actuate the pawl assembly including pawl 52 and arm 54 in a counterclockwise direction about the pivot pin 56. This releases the latching engagement of the pawl 52 by the latch 58 and returns the pawl 52 to the position in which it is biased against the outer rim of the annular portion 41 of member 40.

The pawl means 70 comprises a driving pawl 68 which is pivoted on a pivot pin 71 on the plate 10 and by reason of its shape tends to rotate by gravity in a counterclockwise direction about the pivot pin 71. By this arrangement, an engaging point 69 of the pawl 68 is urged against the outer rim of the annular portion 41 of the member 40 so that the point 69 will move into the lateral slots 27 in the central rim 26 of the ticket wheel 12 by gravity during a ticket issuing stroke. A pawl stop 72 extends from the annular rim 41 and serves to limit the counterclockwise movement of the pawl 68 to maintain the pawl 68 in driving engagement with a slot 27 during an advancing stroke. The point 69 of the pawl 68 will automatically release from engagement with a slot 27 after a predetermined advancing movement because the ticket wheel will be driven through the remainder of the advancing stroke by the action of the detent mechanism 30 as described above. On the return movement of the member 40, the pawl 68 rides on the outer wall of the central rim 26 and returns to the start position as shown in FIG. 3. It is noted that during the initial rotation of the member 40 by the manual operation of the handle 43, the pawl 68 will not cause any movement of the ticket wheel 12. This is approximately for about ten degrees of rotation of the member 40. As will appear hereafter, this non-actuating movement is provided to allow the ticket cutting knife mechanism to drop below the path of the ticket prior to the advancement of the ticket.

Figure 9:
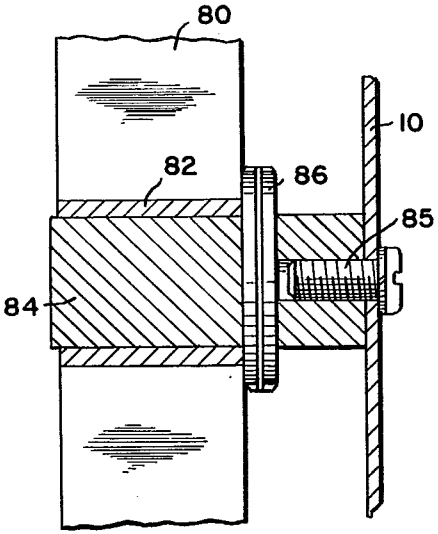
FIG. 9 is a fragmentary sectional view of the roll post assembly.

A ticket supply is provided by a conventional roll 80 which comprises a web of punched tickets wound on a tubular core 82. The ticket web has feed holes spaced along the web a distance equal to the circumferential spacing between the ticket indexing pins 20 so that the pins 20 engage the ticket web at the feed holes. The roll 80 is rotatably supported on a roll post 84 mounted on the plate 10 by means of a mounting screw 85. A roll pin 86 is secured in the roll post 84 and serves to position the roll 80 on the roll post 84 as shown in FIG. 9.

Figure 10:
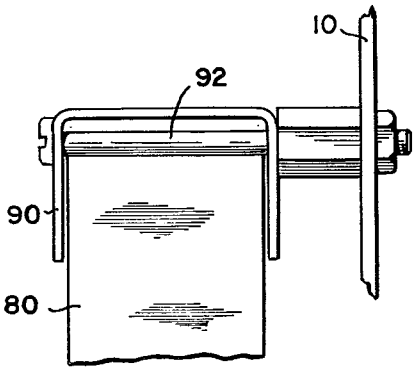
FIG. 10 is a fragmentary sectional view of the roll guide assembly.

Referring to FIG. 10, a roll guide assembly is provided to hold the top portion of the roll 80 in alignment with the ticket wheel 12. The roll guide assembly comprises a channelshaped guide 90 pivoted near one end of a pin 92 mounted on the plate 10 as is shown in FIG. 1 and arranged with side portions extending along the sides of the roll 80. The other end of the guide 90 is provided with a finger 94 which is lanced out of the guide base 91 to project downwardly from the base 91 to contact the top of the roll 80. The finger 94 prevents obstruction of the guide 90 with the feed of the ticket web from the roll 80 in any position of the guide 90.

Figure 2:
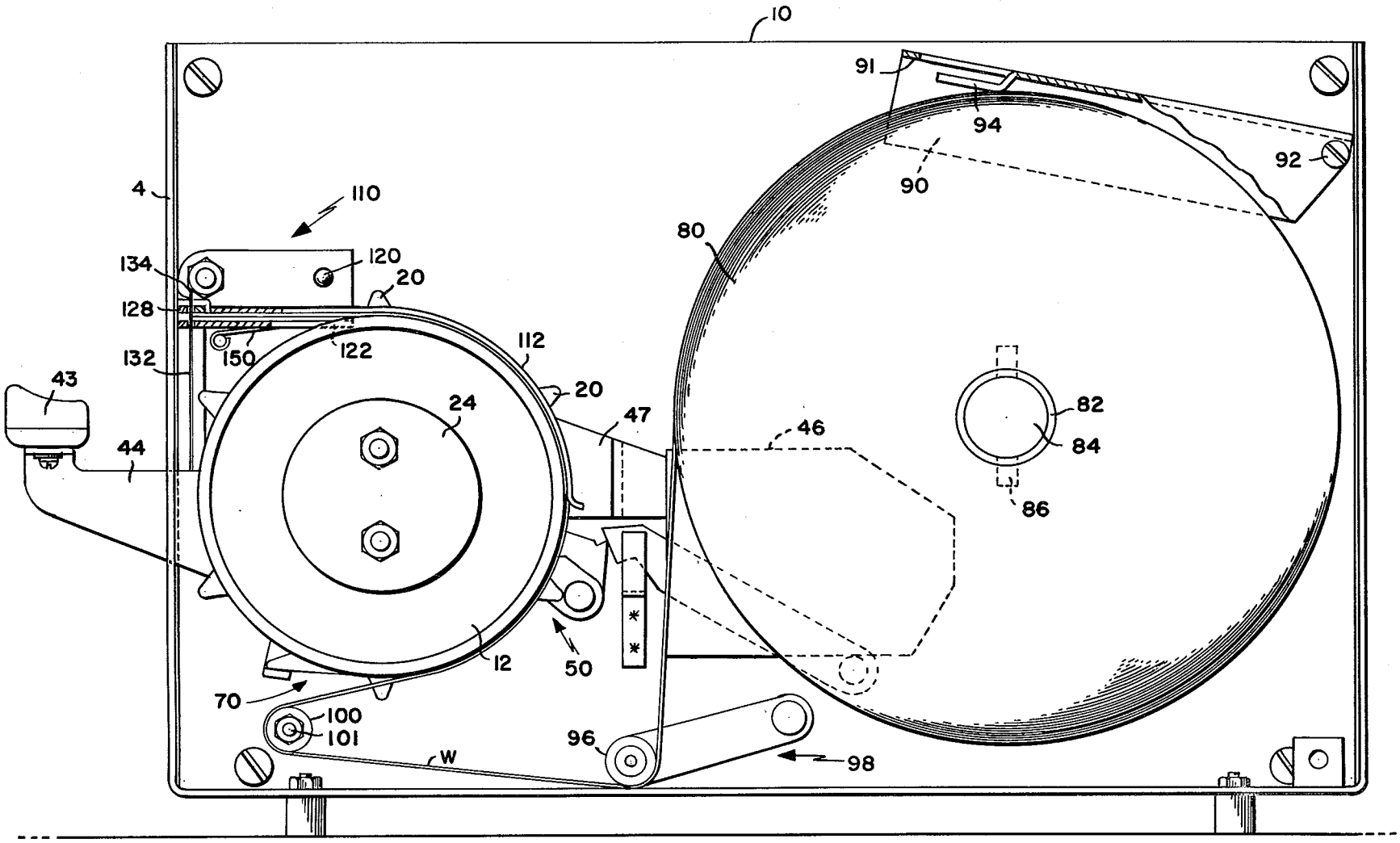
FIG. 2 is an elevational view of the operating mechanism of the ticket issuing machine of FIG. 1 with the cover removed.

The ticket web, which is indicated at "W", is fed from the roll 80 along the path shown in FIG. 2 underneath the roller 96 of a dancer assembly 98, around a roller 100 and onto the periphery of the ticket wheel 12 into engagement with the indexing pins 20 at the feed holes of the ticket web. The rollers 96 and 100 are arranged to feed the ticket web so that it engages an indexing pin 20 at the lower portion of the ticket wheel 12, with the ticket web extending around almost half the circumference of the ticket wheel. The ticket web will always engage at least three indexing pins 20, as is apparent from a consideration of FIG. 2 wherein it is shown that the ticket web is fed horizontally from the top of the ticket wheel 12.

The dancer assembly 98 is conventional and comprises an arm 102 pivoted at a pin 104 mounted on plate 10. The arm 102 carries a pin 106 at its free end adapted to rotatably support roller 96. A spacer 108 on pin 106 positions the roller 96 in alignment with the ticket web.

The roller 100 is rotatably mounted on a pin 101 mounted on the plate 10 in alignment with the ticket web.

Figure 7:
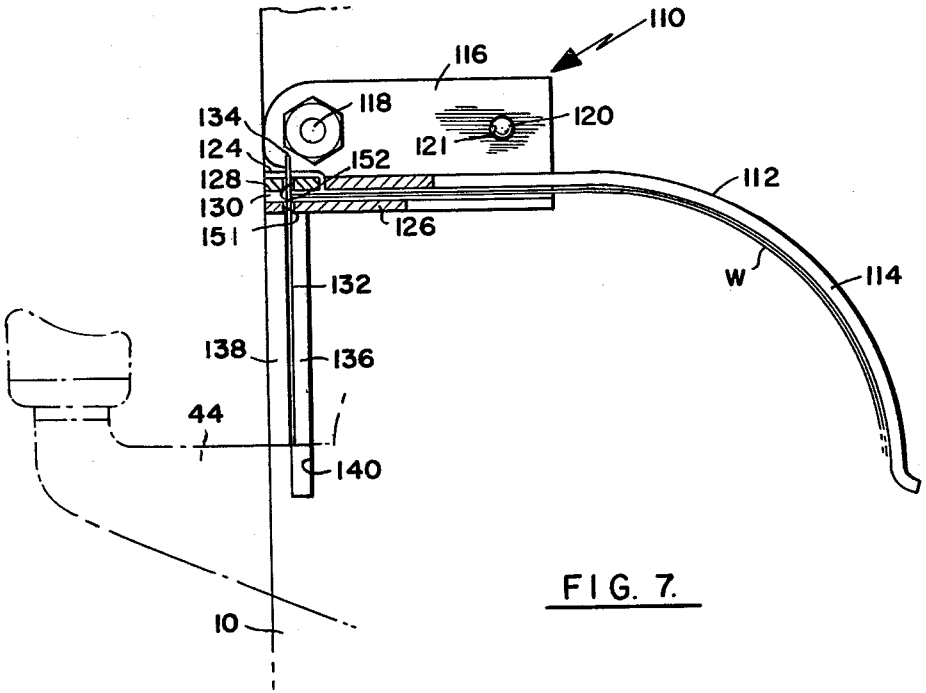
FIG. 7 is a sectional view taken on line 7—7 of FIG. 6.
Figure 6:
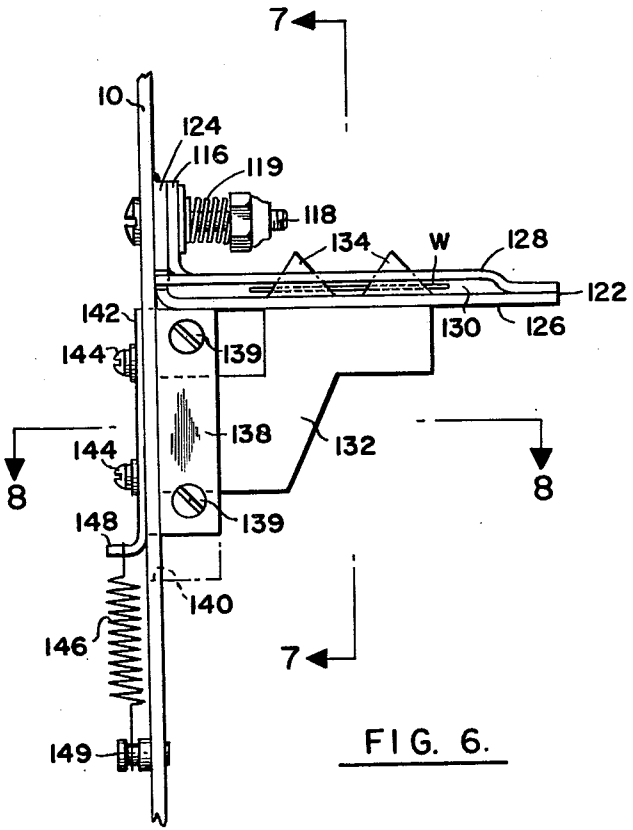
FIG. 6 is a fragmentary view of the knife and ticket chute assembly.

A ticket chute assembly 110 is provided to hold the ticket web on the ticket indexing pins 20 as the web is fed around the ticket wheel 12. The ticket chute assembly 110 comprises a curved portion 112, which extends around the ticket wheel 12 and is provided with a slot 114 to accommodate the ticket indexing pins 20 and a bracket portion 116 pivotally mounted on a threaded pin 118 mounted on plate 10. The ticket chute assembly 110 is releasably held in the position shown in solid lines in FIG. 7 by a projection 120 on a part of a peeler assembly secured by welding against the plate 10. The projection 120 cooperates with a hole 121 in the bracket portion 116. As is shown in FIGS. 6 and 7, a compression spring 119 on the pin 118 urges the bracket portion 116 toward the plate 10 with the projection 120 extending into the hole 122 to position the guide assembly 110 in the operating position shown in the drawings. The guide assembly 110 is pivotable about pin 118 in a counterclockwise direction as viewed in FIG. 7 away from the ticket wheel 12 to provide access to the ticket wheel for threading the ticket web onto the ticket indexing pins 20.

Figure 12:
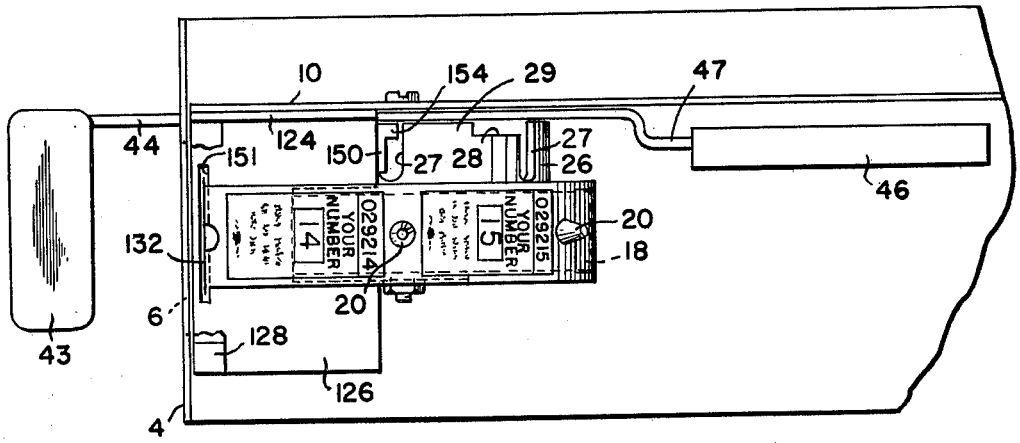
FIG. 12 is a top plan view of FIG. 2 with the ticket holddown chute removed and other parts deleted for the sake of clarity of illustration.

The ticket issuing machine is provided with a conventional peeler assembly for guiding the ticket web horizontally from the periphery of the ticket wheel 12 for issuance from the machine. Such means comprises a right angle shaped peeler plate 122 having a bracket portion 124 secured in position against the plate 10 and a peeler portion 126 extending perpendicularly from the bracket portion 124 horizontally over the top of the ticket wheel 12 as is shown in FIGS. 2 and 12. The peeler portion 126 serves to strip the ticket web from the ticket wheel 12 as the web is fed thereabout and guides the web horizontally towards the slot 6 in the base 4. Adjacent the slot 6 is a guide 128 which is mounted on the peeler portion 126 and has a portion spaced slightly above the top surface of the peeler plate 126 to cooperate therewith to define a horizontal passage 130 through which the ticket web is fed as it is issued from the machine by way of the slot 6. The horizontal passage 130 is aligned with the slot 6.

Figure 8:
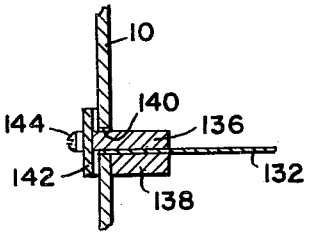
FIG. 8 is a sectional view taken on line 8—8 of FIG. 6.

The ticket issuing machine comprises a knife mechanism for providing transverse cuts or perforations in the ticket web in alignment with the feed holes after a ticket has been fed through the slots 30 and 6. The knife mechanism comprises a knife blade 132 having a pair of pointed edges 134. The knife blade 132 is preferably made of a thin blade of tempered spring steel. A portion of the knife blade 132 is held tightly between a nut place 136 and a clamp plate 138, which plates are secured together by a pair of flat head screws 139 as is shown in FIGS. 6 to 8. The nut plate 136 extends through a vertical slot 140 in plate 10 for engagement with a retainer plate 142 by means of a pair of screws 144 which are threadedly engaged with the nut plate 136. By this arrangement, the knife blade 132, the nut place 136, the clamp plate 138 and the retainer plate 142 are secured together as a unit which is guided for vertical movement within the slot 140. This unit is biased downwardly by means of a knife return spring 146 connected in tension between a horizontal post 148 formed at the lower end of retainer plate 142 and a pin 149 mounted on the plate 10 below the post 148 as is shown in FIG. 6.

The spring 146 biases the knife mechanism downwardly so that the bottoms of the nut plate 136 and the clamp plate 138 are mounted in contact with the handle lever 44 as is shown in FIG. 7. Thus, as the handle lever 44 is moved downwardly during a wheel advancing stroke, the knife mechanism will move downwardly to the bottom of slot 140 (see dashed line position in FIG. 6) by the action of the spring 146. On the return movement of the handle lever 44, the knife mechanism will be returned to the position shown in solid lines in FIGS. 6 and 7 against the bias of spring 146 to perform a ticket cutting action.

As is shown in FIGS. 6 and 7, at the end of a ticket cutting action, the knife blade 132 extends within a slot 151 in the peeler plate portion 146 and a slot 152 in the guide 128. The cutting action is achieved by the pointed knife edges 134 piercing the ticket web as these edges 134 move into the slot 152. The knife edges 134 are dimensioned to pierce the ticket across only a portion of its transverse extent so that the ticket will be retained on the web after the ticket cutting action is completed. The user of the ticket issuing machine may then tear the ticket from the web.

Figure 13:
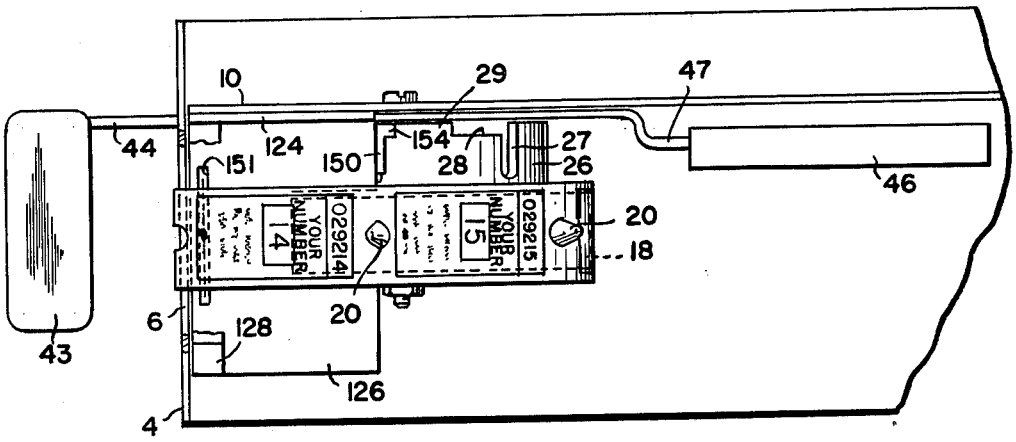
FIG. 13 is a view similar to FIG. 12 with the parts shown in the position of partial ticket wheel rotation.

The ticket issuing machine is provided with an antispin mechanism which prevents the user from manipulating the machine so that more than one ticket can be pulled therefrom at a time. This mechanism is best shown in FIGS. 3, 12 and 13 and comprises a lockarm 150 pivotally mounted on one end of a stud 153 mounted on the plate 10. The other end of the lockarm 150 is provided with a downwardly turned ear 154, the lockarm 150 being mounted so that the ear 154 is aligned with the circumferential slots 28 in the central rim 26 of the ticket wheel 12. A pin 156 is mounted on the annular portion 41 of member 40 to extend horizontally and to move into and out of contact with the bottom wall of the lockarm 150 as the member 40 is rotated back and forth during operation of the ticket issuing machine.

In the start position of the machine, as shown in FIGS. 3 and 12, the pin 156 contacts the lockarm 150 to hold the ear 154 above the central rim 126 of the ticket wheel 12. After the member 40 is rotated in a counterclockwise direction as viewed in FIG. 3 to cause about ten degrees of ticket wheel rotation, the pin 156 moves out of the contact with the lockarm 150 to release the lockarm 150 to allow the ear 154 to fall on a land portion 29 on the outer surface of the central rim 26 in the region between circumferential slots 28. This action can be seen from a comparison of FIGS. 12 and 13. Thus, in FIG. 12, the ear 154 is held above and out of contact with the land portion 29 between the two circumferential slots 28 shown in this figure. In FIG. 13, the ticket wheel 12 is shown after about ten degrees of wheel rotation from the start position, the lockarm 150 being released to fall on the lane 29. The lockarm 150 will ride on this land 29 until about thirty degrees of ticket wheel rotation from the start position at which time the ear 154 will fall into the slot 28 shown in FIG. 13. When this occurs, the ticket wheel 12 is locked from travel beyond sixty degrees from the start position by reason of the ear 154 extending into the slot 28. This sixty degrees rotation serves to advance one ticket from the machine as was described hereinbefore.

When the member 40 returns in a clockwise direction to the start position, the pin 156 will return into contact with the lockarm 150 to raise the ear 154 out of the circumferential slot 28 to the position as is illustrated in FIG. 3.

The operation of the ticket issuing machine in accordance with the invention to issue a single ticket is as follows:

When a user desires to issue a ticket from the machine, the handle 43 is moved manually from the rest position through a downward stroke to cause about forty-five degrees of rotation of the member 40. The user then releases the handle 43 whereupon the handle moves through an upward return stroke under the bias of the counterweight 46 to return to the rest position. This simple action results in the issuance of a single ticket from the slot 6, the ticket being held within the machine in a partially cut condition so that it can be removed easily by the user.

The downward stroke of the handle 43 involves a number of mechanical actions. During the first portion of the downward stroke involving about ten degrees of rotation of the member 40, the handle lever 44 moves downwardly an amount to allow the knife mechanism to move downwardly so that the knife edges 134 are below the slot 130. This clears the slot 130 for the passage of the ticket issuing web therethrough. After this clearing movement, the pawl means 70 comes into engagement with the ticket wheel 12 at a slot 27 (FIG. 3). During the remainder of the downward stroke of handle 43, the pawl means 70 causes about thirty-five degrees of rotation of the ticket wheel 12, which rotation is the first part of a ticket issuing stroke. At the end of this first portion of the rotation of the ticket wheel 12, the detent mechanism 30 comes into action to cause the ticket wheel 12 to move through the remainder of its ticket issuing stroke. The total ticket issuing stroke is sixty degrees of rotation of the ticket wheel 12, which causes the feeding of one ticket length past the knife blade 132 of the knife mechanism.

During this ticket issuing stroke, the pawl means 50 functions to insure that once the ticket issuing stroke is started, it must be completed for a full stroke. To this end, the pawl means 50, by reason of the engagement of pawl 52 with teeth 51, prevents a clockwise movement of the member 40, as viewed in FIG. 3, until the ticket wheel has moved an amount to bring the detent mechanism 30 into action to actuate the ticket wheel 12 through the remaining portion of the ticket issuing stroke. Also, during the ticket issuing stroke, the lockarm 150 functions as an anti-spin mechanism to arrest the ticket wheel 12 at the end of the ticket issuing stroke.

At the end of the downward stroke of the handle 43, the post 64 operates to release the pawl 52 from engagement with the teeth 51 and to move the pawl 52 into engagement with the latch arm 58. The latch arm 58 serves to hold the pawl 52 out of engagement with teeth 51 to permit the return movement of the member 40 during the upward stroke of the handle 43.

The upward stroke of the handle 43 is caused by the action of the counterweight 46 to effect a clockwise movement of the member 40 as viewed in FIG. 3. The counterweight 46 is designed to be heavy enough to return the handle 43 to the rest position at a speed sufficient to produce an effective cutting action by the knife mechanism. During this upward movement of the handle 43, the handle lever 44 comes into contact with the bottom of members 136 and 138 to move the knife blade 132 upwardly at a speed to cause the knife edges 134 to pierce the ticket web which has been fed into the slot 130 by the previous ticket issuing stroke. The ticket in slot 130 is located above the slots 151 and 152. The ticket web is then cut in a transverse line in the region aligned with slots 151 and 152 and held within the machine in this partially cut position with a portion of the ticket web extending from the slot 6. The user can then easily remove a single ticket by tearing it from the ticket web, the ticket tearing along a transverse line aligned with the slots 151 and 152.

I claim:

1. A ticket issuing machine comprising:

a supply of tickets having feed holes spaced along a web, a ticket wheel rotatably mounted adjacent said supply of tickets and having pins projecting from the periphery thereof, said pins being spaced circumferentially around the periphery of the ticket wheel for engaging the ticket web at said feed holes, means guiding the ticket web from said supply of tickets onto the periphery of the ticket wheel for engagement with said pins at said feed holes, means for guiding said ticket web from the periphery of said ticket wheel for issuance from the machine, and means for rotatably advancing said ticket wheel through a stroke to issue one ticket from the machine including manually operable means engageable with said ticket wheel for causing rotation thereof through the first part of said ticket issuing stroke, and spring operated means for causing rotation of said ticket wheel through the remainder of said ticket issuing stroke, said ticket wheel having a polygonal shaped inner rim providing a plurality of circumferentially equally spaced apexes, said spring operated means including a detent mechanism having spring means and bearing means urged by said spring means into the apexes of said inner rim.

2. A ticket issuing machine according to claim 1 wherein said manually operable means includes a handle movable from a rest position through a ticket wheel advancing stroke and a subsequent returning stroke to a rest position, a member mounted for rotational movement, means mechanically interconnecting said handle and said member for causing rotational movement of said member in response to movement of said handle through said ticket wheel advancing stroke, and means for engaging said member with said ticket wheel when said member is rotated by said handle for causing rotation of said ticket wheel through said first part of said ticket issuing stroke.

3. A ticket issuing machine according to claim 1 including means for insuring that the ticket wheel will move through the full ticket issuing stroke after the ticket wheel has been rotated by said manually operable means to start said ticket issuing stroke.

4. A ticket issuing machine according to claim 3 including means for arresting said ticket wheel at the end of said ticket issuing stroke to prevent the further advance of the ticket web, and a knife mechanism for cutting said ticket web at the trailing end of a ticket after the ticket has been issued from the machine.

5. A ticket issuing machine according to claim 4 wherein said manually operable means includes a handle movable from a rest position through a ticket wheel advancing stroke and a subsequent return stroke to the rest position and including means for operating said knife mechanism through a cutting movement in response to the movement of said handle means through said return stroke.

6. A ticket issuing machine according to claim 4 wherein said manually operable means includes a handle movable from a rest position through a ticket wheel advancing stroke and a subsequent return stroke to the rest position and including means for releasing said ticket wheel arresting means upon return of said handle to the rest position thereof.

7. A ticket issuing machine according to claim 4 wherein said spring operated means comprises a detent mechanism including spring means and a member urged into contact with said ticket wheel by said spring means.

8. A ticket issuing machine according to claim 1 including means for arresting said ticket wheel at the end of said ticket issuing stroke to prevent the further advance of the ticket web.

9. A ticket issuing machine according to claim 8 wherein said manually operable means includes a handle movable from a rest position through a ticket wheel advancing stroke and a subsequent return stroke to the rest position, and including means for releasing said ticket wheel arresting means upon return of said handle to the rest position thereof.

10. A ticket issuing machine according to claim 1 including knife mechanism for cutting said ticket web at the trailing end of a ticket after the ticket has been issued from the machine.

11. A ticket issuing machine according to claim 10 wherein said manually operable means includes a handle movable from a rest position through a ticket wheel advancing stroke and a subsequent return stroke to the rest position, and including means for operating said knife mechanism through a cutting movement in response to the movement of said handle means through said return stroke.

12. A ticket issuing machine according to claim 1 wherein said supply of tickets comprises a roll mounted for rotation about its axis, and including a roll guide pivoted near one end and having side portions extending along the side of the top portion of said roll for holding said roll in alignment with said ticket wheel and a base portion provided with a finger to contact the top of said roll.

13. A ticket issuing machine comprising:

a supply of tickets having feed holes spaced along a web, a ticket wheel rotatably mounted adjacent said supply of tickets and having pins projecting from the periphery thereof, said pins being spaced circumferentially around the periphery of the ticket wheel for engaging the ticket web at said feed holes, means guiding the ticket web from said supply of tickets onto the periphery of the ticket wheel for engagement with said pins at said feed holes, means for guiding said ticket web from the periphery of said ticket wheel for issuance from the machine, and means for rotatably advancing said ticket wheel through a stroke to issue one ticket from the machine including manually operable means engageable with said ticket wheel for causing rotation thereof through the first part of said ticket issuing stroke, and spring operated means for causing rotation of said ticket wheel through the remainder of said ticket issuing stroke, means for insuring that the ticket wheel will move through the full ticket issuing stroke after the ticket wheel has been rotated by said manually operable means to start said ticket issuing stroke, means for arresting said ticket wheel at the end of said ticket issuing stroke to prevent the further advance of the ticket web, and a knife mechanism for cutting said ticket web at the trailing end of a ticket after the ticket has been issued from the machine, said manually operable means including a handle movable from a rest position through a ticket wheel advancing stroke, and a subsequent return stroke to the rest position, and including means for operating said knife mechanism through a cutting movement in response to the movement of said handle means through said return stroke, said manually operable means including a member mounted for rotational movement, said handle being mounted on a lever arm extending radially in one direction from the axis of rotation of said member, and including a counterweight mounted on an arm extending radially in the opposite direction from the axis of rotation of said member whereby said counterweight biases said member toward the rest position 14. A ticket issuing machine comprising:

a supply of tickets having feed holes spaced along a web, a ticket wheel rotatably mounted adjacent said supply of tickets and having pins projecting from the periphery thereof, said pins being spaced circumferentially around the periphery of the ticket wheel for engaging the ticket web at said feed holes, means guiding the ticket web from said supply of tickets onto the periphery of the ticket wheel for engagement with said pins at said feed holes, means for guiding said ticket web from the periphery of said ticket wheel for issuance from the machine, and means for rotatably advancing said ticket wheel through a stroke to issue one ticket from the machine including manually operable means engageable with said ticket wheel for causing rotation thereof through the first part of said ticket issuing stroke, and spring operated means for causing rotation of said ticket wheel through the remainder of said ticket issuing stroke, means for insuring that the ticket wheel will move through the full ticket issuing stroke after the ticket wheel has been rotated by said manually operable means to start said ticket issuing stroke, means for arresting said ticket wheel at the end of said ticket issuing stroke to prevent the further advance of the ticket web, and a knife mechanism for cutting said ticket web at the trailing end of a ticket after the ticket has been issued from the machine, said ticket wheel having a hexagonal shaped inner rim, said spring operated means including a detent mechanism having a spring and roller bearings urged by said spring into the apexes of said hexagonal shaped inner rim.

15. A ticket issuing machine according to claim 13 wherein said means for insuring that said ticket wheel moves through a full stroke includes a pawl means engageable with said rotatable member of said manually operable means.

16. A ticket issuing machine according to claim 15 including means on said rotatable member of said manually operable means for disengaging said pawl means after said first part of said ticket issuing stroke.

17. A ticket issuing machine according to claim 15 including latch means for holding said pawl means disengaged to permit said rotatable member to return to the rest position after a movement of said handle through said ticket wheel advancing stroke.

18. A ticket issuing machine according to claim 17 including means on said rotatable member of said manually operable means for releasing said latch means from its hold on said pawl means to permit said pawl means to move to a position for engagement with said rotatable member.

* * * * *